US008026825B2

(12) United States Patent
Santos

(10) Patent No.: US 8,026,825 B2
(45) Date of Patent: Sep. 27, 2011

(54) LIGHT SENSING PULL STATION

(75) Inventor: Fred Santos, Easton, PA (US)

(73) Assignee: Siemens Industry, Inc., Alpharetta, GA (US)

( * ) Notice: Subject to any disclaimer, the term of this patent is extended or adjusted under 35 U.S.C. 154(b) by 435 days.

(21) Appl. No.: 12/199,506

(22) Filed: Aug. 27, 2008

(65) Prior Publication Data

US 2009/0058669 A1 Mar. 5, 2009

Related U.S. Application Data

(60) Provisional application No. 60/967,118, filed on Aug. 31, 2007.

(51) Int. Cl.
*G08B 3/00* (2006.01)
*G08B 5/00* (2006.01)
*G08B 7/00* (2006.01)

(52) U.S. Cl. ..... 340/691.1; 340/693.5

(58) Field of Classification Search ..... 340/691.1, 340/691.6, 693.5, 600
See application file for complete search history.

(56) References Cited

U.S. PATENT DOCUMENTS

| | | | | |
|---|---|---|---|---|
| 3,573,541 | A | 4/1971 | Dunn et al. | |
| 5,760,678 | A * | 6/1998 | Pavlacka et al. | 340/287 |
| 6,380,846 | B1 * | 4/2002 | Hohlfelder | 340/286.05 |
| 6,970,183 | B1 | 11/2005 | Monroe | |

FOREIGN PATENT DOCUMENTS

| | | | |
|---|---|---|---|
| DE | 545896 | C | 3/1932 |
| GB | 2370670 | A1 | 7/2002 |
| WO | 200104853 | A1 | 1/2001 |

OTHER PUBLICATIONS

International Search Report including Notification of Transmittal of the International Search Report, International Search Report and Written Opinion of the International Searching Authority (2007P18628WO).

* cited by examiner

*Primary Examiner* — Travis Hunnings

(57) ABSTRACT

An alarm pull station includes a housing, an alarm indicator carried within the housing, an alarm activation mechanism carried within the housing, such that the alarm activation mechanism is adjacent to the alarm indicator, and configured to generate an alarm signal, and a sensor carried within the housing such that the sensor is configured to generate a signal in response to a sensed condition and the alarm indicator is activated in response to the signal generated by the sensor.

14 Claims, 3 Drawing Sheets

LIGHT SENSING PULL STATION

CROSS-REFERENCE TO RELATED APPLICATIONS

This patent claims the priority benefit under 35 U.S.C. §119(e) of U.S. provisional patent application Ser. No. 60/967,118, submitted on Aug. 31, 2007; the content of which is hereby incorporated by reference for all purposes.

BACKGROUND

Known fire alarm pull stations are often wall-mounted fire protection devices that, when activated or otherwise utilized to signal a fire alert, communicate and/or initiate an alarm within a fire alarm system. In operation, a user activates or initiates the alarm by pulling, for example, a handle down or triggering a switch. This action, in turn, completes a circuit and locks the handle in the activated position. An alarm signal is communicated from the alarm pull station to a fire alarm control panel over an emergency communication and/or building control network. Known fire alarm pull stations are often manually reset utilizing a key or code. The resetting of an activated alarm pull station allows or triggers the handle or switch to return to a normal position. Returning the handle or switch to the normal position resets the alarm pull station but will not, in most cases, reset or deactivate the alarm signal.

SUMMARY

The present disclosure provides teaching and disclosure related to the configuration and illumination of an alarm pull station. In particular, the present invention relates to alarm pull stations which are configured to include one or more light sensors in communication with a light source. In operation, the light sensor may detect, for example, a low-light condition within a given area. The light sensor may then generate and communicate a low light signal to the light source. The low-light signal may be configured to activate the light source and thereby illuminate the alarm pull station and/or components thereof.

Other embodiments are disclosed, and each of the embodiments can be used alone or together in combination. Additional features and advantages of the disclosed embodiments are described in, and will be apparent from, the following Detailed Description and the figures.

DETAILED DESCRIPTION

The present discloses provides teaching and disclosure related to the configuration and illumination of an alarm pull station. In particular, the present invention relates alarm pull stations which are configured to include one or more light sensors in communication with a light source. In operation, the light sensor may detect, for example, a low-light condition within a given area. The light sensor may then generate and communicate a low light signal to the light source. The low-light signal may be configured to activate the light source and thereby illuminate the alarm pull station, components thereof and/or an area adjacent thereto.

Figure 1:
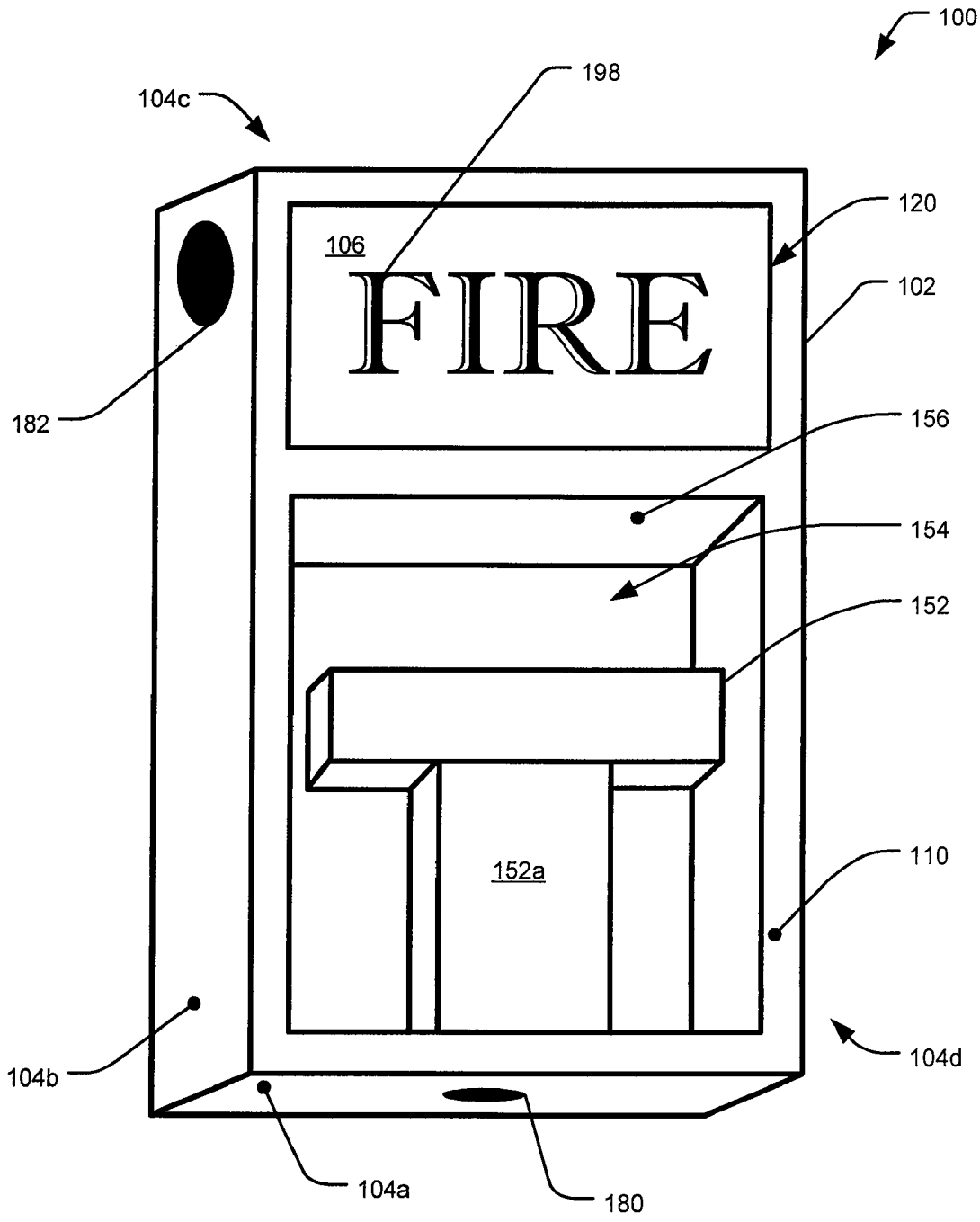
FIG. 1 illustrates one embodiment of an alarm pull station constructed in accordance with the teaching provided herein.

FIG. 1 illustrates one embodiment of a light sensing pull station 100 constructed in accordance with the teaching and disclosure provided herein. The light sensing pull station 100 includes a housing 102 which may be constructed from a metal casing and which may be colored or painted a high visibility color such as, for example, red, yellow or orange. Alternatively, the housing 102 may be constructed or manufactured from a plastic material which has been provided with a high visibility color or pigment such as, for example, red, yellow or orange.

The housing 102 may be a substantially rectangular housing that includes sides 104*a* to 104*d*. In this embodiment, the sides 104*a* to 104*d* are substantially longer than they are wide resulting in the housing 102 having a substantially flat and elongated shape. However, it will be understood that the housing 102 may be manufactured with virtually any shape or configuration which may be accessible and/or recognizable to a user.

The housing 102 may further include an alarm indicator 120 and an alarm activation mechanism 150. The alarm indicator 120 may include, for example, a translucent panel 106 carrying the "FIRE" textual indication 108. Alternative textual indications such as, for example, "FUEGO" and "HELP", may be utilized based on the purpose, language and/or location of the light sensing pull station 100. A light source may be disposed behind the translucent panel 106. Upon activation from, for example, the user, an alarm signal may be generated or received from the fire protection system and/or building control system. The alarm signal may, in turn, be utilized to activate the light source and illuminate the translucent panel 106 and the "FIRE" textual indication 108. The light source may be, for example, a light emitting diode (LED), an incandescent and/or a halogen bulb. Alternatively, the light source may be configured as a strobe light or other attention attracting device. In yet another alternative the light source may operation in connection and/or cooperation with an audible buzzer, alarm or other indicator.

The alarm activation mechanism 150 may include, for example, an activation handle 152 positioned within a recess 154 formed into the housing 102. In this way, an outer surface 152*a* of the activation handle 152 may be aligned substantially flush with the outer surface 110 of the housing 102. In an alternate embodiment, the alarm activation mechanism 150 may include a switch, toggle or pushbutton extending from, or formed flush with, the outer surface 110 of the housing 102.

The alarm activation mechanism 150 may further include a translucent panel 156 within the recess 154. The translucent panel 156 may be position to communicate light generated by the light source portion of the alarm indicator 120. The light from the translucent panel 156 may, in turn, illuminate the activation handle 152, switch, pushbutton or other activation mechanism. Upon activation or initiation of an alarm or alarm condition, an alarm signal may be generated by the light sensing pull station 100 and communicated to the fire protection system and/or building control system. The alarm signal may further be communicated to the light source portion of the alarm indicator 120.

The housing 102 may further include a light sensor 180 and/or a smoke, carbon dioxide ($CO_2$), carbon monoxide (CO) sensor 182. In operation, the light sensor 180 may detect a low light condition within a room or area and generate a light level signal representative of the detected condition. The generated light level signal may be communicated to the alarm indicator 120 thereby causing the light source to be activated. Thus, when the room or area around the light sensing pull station 100 darkens past a predetermined limit associated with the light sensor 180, the alarm indicator 120 is automatically illuminated by the light source. Similarly, when the smoke sensor 182 detects smoke or other airborne fumes, a smoke sensor signal may be communicated to the alarm indicator 120 to activate the light source.

Figure 2:
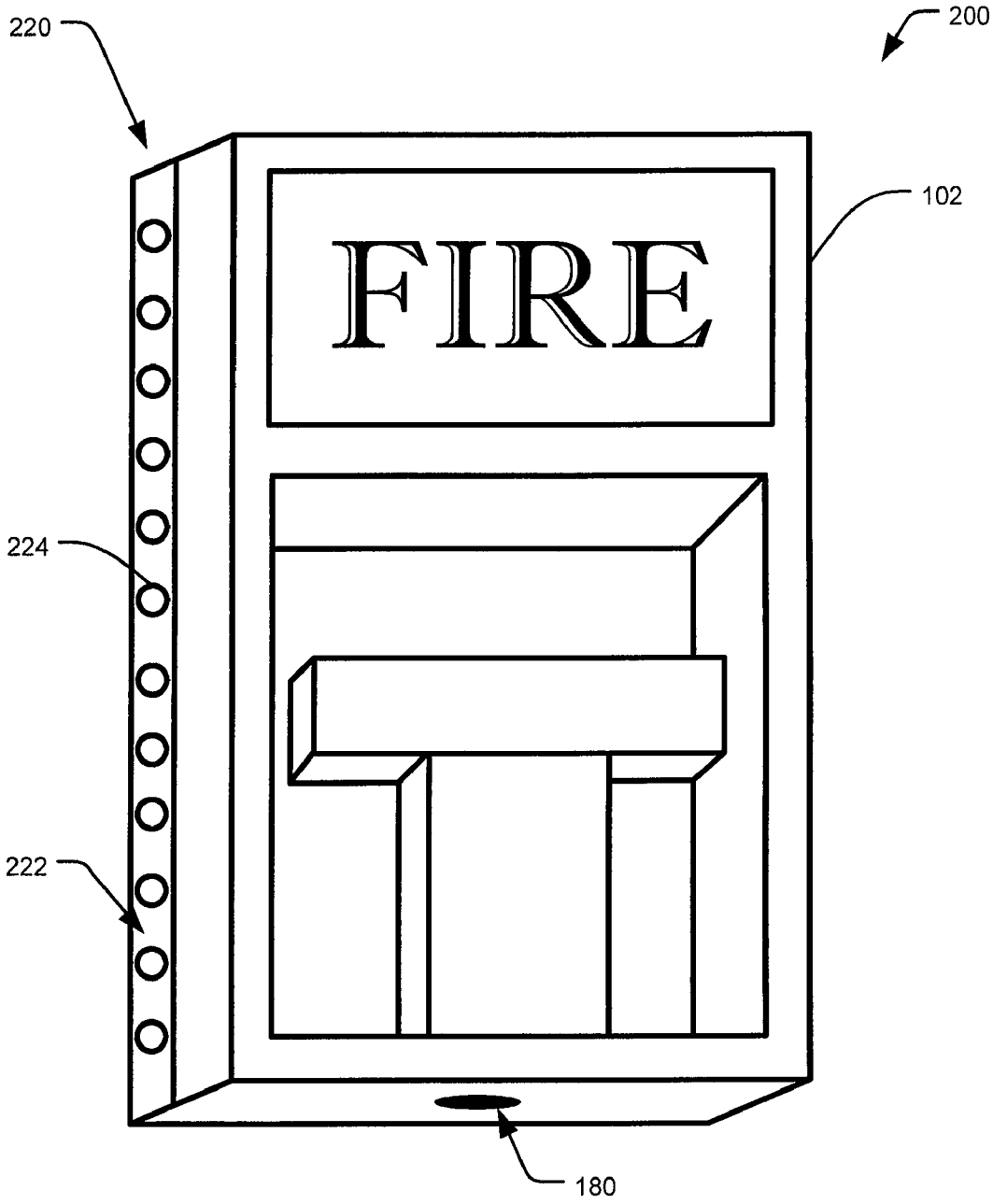
FIG. 2 illustrates another embodiment of the alarm pull station shown in FIG. 1.

FIG. 2 illustrates an alternate embodiment of a light sensing pull station 200. In this exemplary embodiment, an alarm indicator 220 includes a light source 222 carried along the perimeter of the housing 102 which may be activated in cooperation with the light sensor 180. For example, the light source 222 may include multiple light emitting diodes (LEDs) 224 arrayed in a strip along the sides 104*a* to 104*d* of the housing 102. The number, position and intensity of the LEDs 224 may be adjusted to, for example, illuminate a specific area of the area, wall or floor. In this way, the LEDs 224 may, for example, draw attention to the light sensing pull station 200, signage in the vicinity, the floor and area adjacent to the light sensing pull station 200, hazards in the vicinity of the light sensing pull station 200, and any other items of interest and/or concern.

Figure 3:
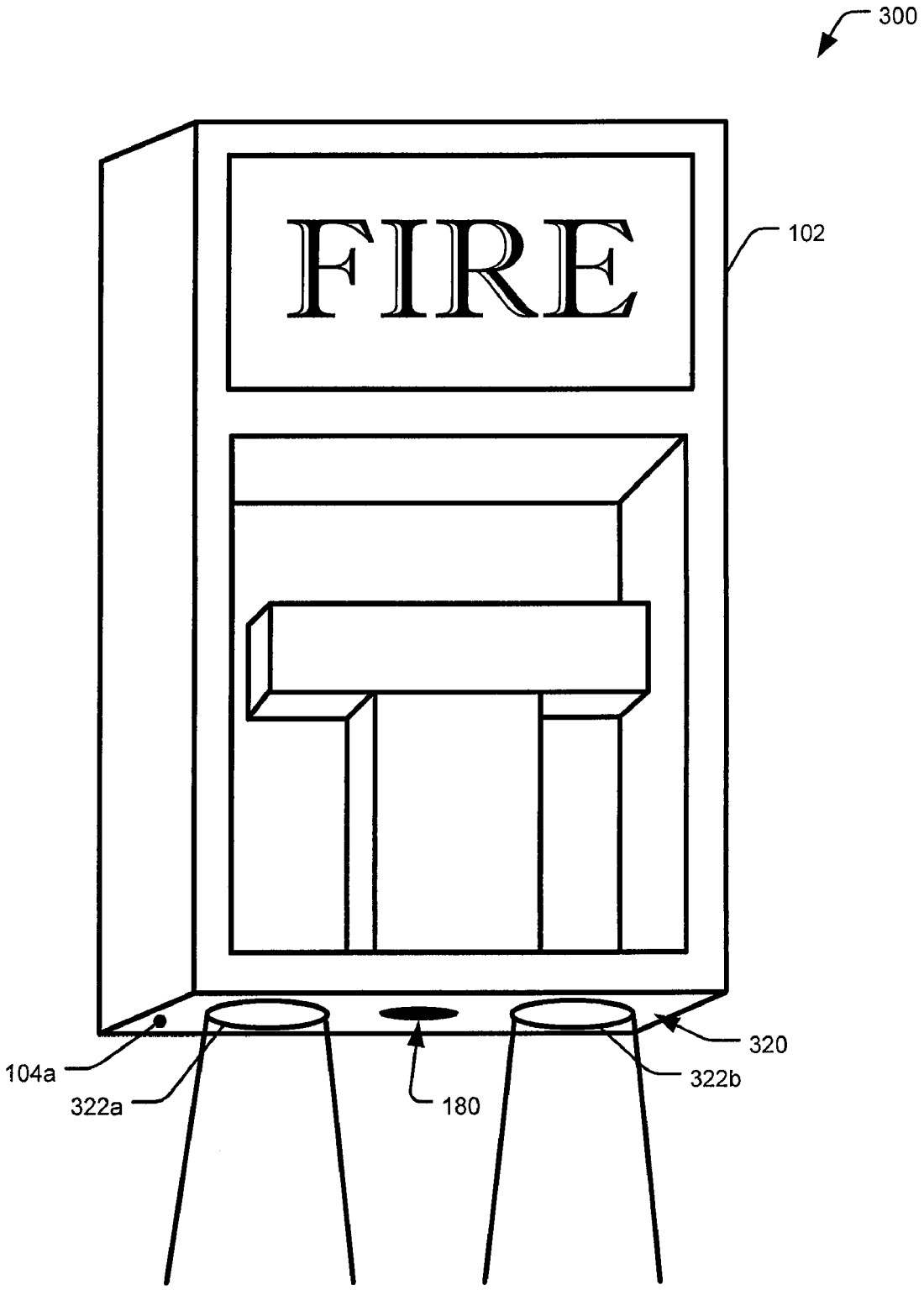
FIG. 3 illustrates another embodiment of the alarm pull station shown in FIGS. 1 and 2.

FIG. 3 illustrates an alternate embodiment of a light sensing pull station 300. In this exemplary embodiment, an alarm indicator 320 includes a pair of light sources 322*a*, 322*b* carried by the bottom side 104*a* substantially adjacent to the light sensor 180. The pair of light sources 322*a*, 322*b* may be a pair of light emitting diodes (LEDs), incandescent bulbs, a fluorescent array, of any other light emitting device. The pair of light sources 322*a*, 322*b*, in this embodiment, may be directed or focused on the wall and floor adjacent to the light sensing pull station 300. Thus, in case of an emergency where smoke or other fumes have forced the occupants of a space to crawl, the light sensing pull station 300 directs light from the pair of light sources 322*a*, 322*b* towards the floor as a guide or indicator.

The light sensing pull stations 100 to 300 may include, for example, a battery pack, capacitor or other energy storage device. Circuitry or other control device(s) may be configured to activate the alarm indicator(s) 120, 220 and 320 in response to a received alarm signal, a loss of external power and/or a sensor signal received from the sensor(s) 180, 182.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. An alarm pull station comprising:

a housing;

an alarm indicator carried within the housing;

an alarm activation mechanism carried within the housing at a position substantially adjacent to the alarm indicator, and configured to generate an alarm signal; and an air quality sensor carried within the housing, wherein the air quality sensor is configured to generate a signal in response to a sensed air quality condition;

wherein the alarm indicator is activated in response to the air quality signal generated by the sensor; and wherein the alarm indicator is activated in response to the alarm signal generated by the alarm activation mechanism.

2. The alarm pull station of claim 1, wherein the alarm indicator includes a light generating device.

3. The alarm pull station of claim 1, wherein the alarm activation mechanism is selected from the group consisting of: a handle, a push button, and a panel.

4. The alarm pull station of claim 1, wherein the alarm indicator includes a translucent panel.

5. The alarm pull station of claim 1, wherein the air quality sensor is selected from the group consisting of: a light sensor; a smoke sensor; a carbon dioxide ($CO_2$) sensor; and a carbon monoxide (CO) sensor.

6. The alarm pull station of claim 1, wherein the alarm indicator is activated in response to another alarm signal generated by a building control system in communication with the alarm activation mechanism.

7. An alarm pull station comprising:

a housing having an outer surface and a bottom side;

an alarm indicator including a light source, wherein the light source is disposed in the bottom side and directed downward;

an alarm activation mechanism carried within the housing and disposed substantially flush with the outer surface of the housing, wherein the alarm activation mechanism is configured to generate an alarm signal; and a sensor carried within the housing, wherein the sensor is configured to generate a signal in response to a sensed condition;

wherein the alarm indicator is activated in response to the signal generated by the sensor; and wherein the alarm indicator is activated in response to a second alarm signal generated by a fire protection system in communication with the alarm activation mechanism.

8. The alarm pull station of claim 7, wherein the light source is selected from the group consisting of: a light emitting diode; an incandescent bulb and a fluorescent bulb.

9. The alarm pull station of claim 7, wherein the alarm activation mechanism is selected from the group consisting of: a handle, a push button, and a panel.

10. The alarm pull station of claim 7, wherein the alarm indicator includes a translucent panel.

11. The alarm pull station of claim 7, wherein the sensor is selected from the group consisting of: a light sensor; a smoke sensor; a carbon dioxide ($CO_2$) sensor; and a carbon monoxide (CO) sensor.

12. A method of illuminating an alarm pull station, the method comprising:

providing an alarm housing;

securing a sensor within the alarm housing, wherein the sensor is configured to generate a sensor signal;

receiving an alarm signal from a fire protection system in communication with the alarm pull station;

coupling an alarm indicator to the sensor, wherein the alarm indicator includes a light source; and activating the light source in response to receipt of either the sensor signal or the alarm signal at the alarm indicator.

13. The method of claim 12, wherein the light source is selected from the group consisting of: a light emitting diode; an incandescent bulb and a fluorescent bulb.

14. The method of claim 12, wherein the sensor is selected from the group consisting of: a light sensor; a smoke sensor; a carbon dioxide (CO2) sensor;

and a carbon monoxide (CO) sensor.

* * * * *